United States Patent [19]

Prijs

[11] Patent Number: 4,494,099

[45] Date of Patent: Jan. 15, 1985

[54] HIGH-FREQUENCY COIL STRUCTURE

[75] Inventor: Pieter R. Prijs, Eindhoven, Netherlands

[73] Assignee: U.S. Philips Corporation, New York, N.Y.

[21] Appl. No.: 575,955

[22] Filed: Feb. 1, 1984

[30] Foreign Application Priority Data

Feb. 11, 1983 [NL] Netherlands ..... 8300513

[51] Int. Cl.[3] ..... H01F 5/00

[52] U.S. Cl. ..... 335/299; 335/133

[58] Field of Search ..... 335/196, 199, 202, 133, 335/296, 299

[56] References Cited

U.S. PATENT DOCUMENTS 4,185,163 1/1980 Schedele ..... 335/202

4,383,232 5/1983 Richert ..... 335/202

*Primary Examiner*—George Harris

*Attorney, Agent, or Firm*—Thomas A. Briody; William J. Streeter

[57] ABSTRACT

A high-frequency coil has a coil winding provided on a coil form whose axis extends perpendicularly to a base. The base has wire-shaped connection contacts which extend perpendicularly to the axis and which are embedded in the material of the base so that both their ends project from the base. The coil can be mounted with its axis perpendicular to a board with surface wiring without bending of the connection contact.

5 Claims, 4 Drawing Figures

HIGH-FREQUENCY COIL STRUCTURE

BACKGROUND OF THE INVENTION

1. Field of the Invention

The invention relates to a high-frequency coil comprising a coil winding which is provided on a coil form whose axis extends perpendicularly to a base which comprises wire-shaped connection contacts which extend perpendicularly to the axis and which are embedded in the material of the base so that both their ends project from the base, at least one lead of the coil winding being connected to the first end whilst the second end serves to establish electrical contact with the coil.

2. Description of the Prior Art

A high-frequency coil of this kind is known from Netherlands Patent Application No. 70 07 686 (PHN 4863) laid open to public inspection. It is also known therefrom to bend the second end of the connection contacts through 90° in order to enable mounting of the coil with its axis perpendicular to the plane of a board comprising surface wiring. During bending of the material of the connection contact as well as that of the base is subjected to a mechanical stress; this imposes restrictions as regards the choice of the properties and the thickness of these materials. Moreover, the length of the part to be bent usually is not sufficient for fixing the coils temporarily in a tape-like carrier as is often desirable for the automated mounting of the coils on a board comprising surface wiring.

It is an object of the invention to render a high-frequency coil of the kind set forth suitable for mounting with its axis perpendicular to a board, possibly using an automated mounting process, without bending of the connection contacts being necessary.

SUMMARY OF THE INVENTION

To this end, the coil in accordance with the invention is characterized in that it comprises connection pins, each of which comprises a first end portion which extends parallel to the second end of one of the connection contacts and which is electrically connected thereto, and also comprises a second end portion which extends perpendicularly to the first end portion and parallel to the axis of the coil form.

The connection between the connection pin and the connection contact is preferably formed by a welded joint.

The invention will be described in detail hereinafter with reference to the accompanying drawing.

DESCRIPTION OF THE PREFERRED EMBODIMENTS

Figure 1:
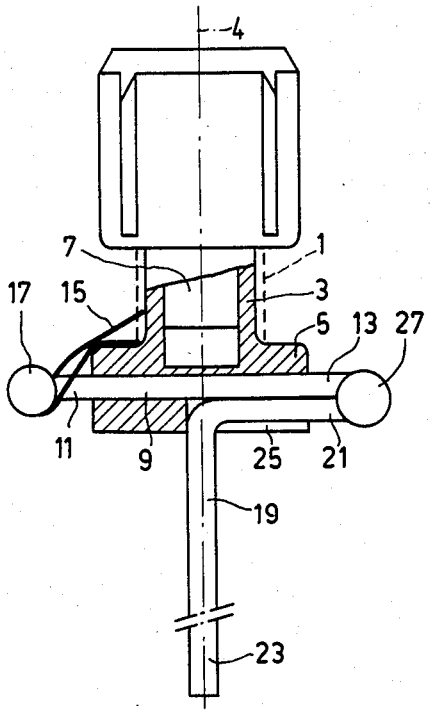
FIG. 1 is partly a side elevation and partly a longitudinal sectional view of a first embodiment of a high-frequency coil in accordance with the invention.
Figure 2:
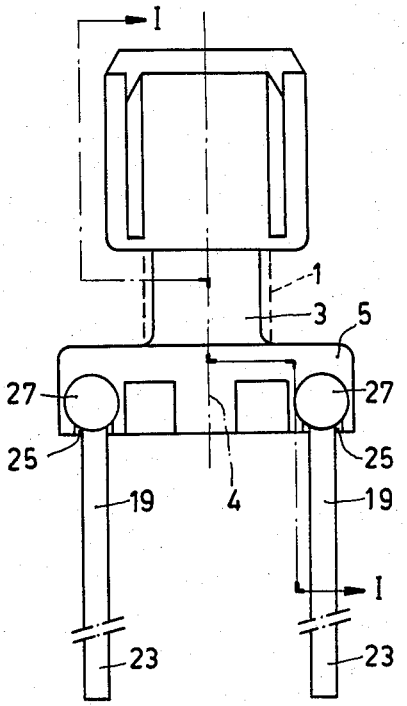
FIG. 2 is a side elevation of the coil shown in FIG. 1.

The high-frequency coil shown in the FIGS. 1 and 2 comprises a coil winding 1 (denoted by dotted lines) which is provided on a coil form 3 which is made of an insulating material and whose axis 4 extends perpendicularly to a base 5. The coil form 3 and the base 5 are preferably formed as one plastic unit, and a ferromagnetic core 7 is displaceable in the coil form. If desired, the coil form 3 may be made of a ferromagnetic material (for example, ferrite) and be connected to the base 5, for example, by gluing.

Wire-shaped connection contacts 9, for example, made of phosphor bronze, are embedded in the material of the base 5, the ends 11, 13 of said contacts projecting from the base. A lead 15 of the coil winding 1 is connected to the first end 11, for example, by way of a welded or soldered joint 17. If desirable, several leads 15 may be connected to one first end 11. The second end 13 of the connection contact 9 serves to establish an electrical connection between the coil and, for example, a board comprising surface wiring. Therefore, this second end is connected to a connection pin 19 which is bent so as to be L-shaped in this embodiment, so that it comprises two end portions 21, 23 which extend perpendicularly with respect to one another. The connection pin 19 may be made, for example, of copper wire. The first end portion 21 extends parallel to the second end 13 of the connection contact 9 in a groove 25 which is recessed in the base 5 and which also accommodates the portion of the connection contact which adjoins the second end thereof. The second end 13 and the first end portion 21 contact one another and are electrically and mechanically interconnected, preferably by way of a welded joint 27. The second end portion 23 of the connection pin 19 extends parallel to the axis 4 of the coil former 3. The embodiment shown comprises two connection pins 19, the second end portions 23 of which are situated in the same plane as the axis 4 of the coil former 3 (the plane of drawing of FIG. 2). This is attractive for the automated mounting of the coil on a board comprising surface wiring.

Figure 3:
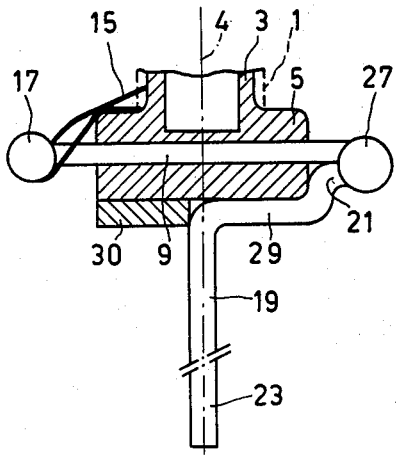
FIG. 3 shows a detail of a second embodiment.

FIG. 3 is a sectional view of the base 5 of a second embodiment of the high-frequency coil in accordance with the invention; this view corresponds to FIG. 1 and corresponding parts are denoted by the same reference numerals as used in FIG. 1. In the present embodiment the connection pin 19 is bent through 90° in three locations. Consequently, it comprises not only two perpendicularly extending first and second end portions 21, 23 but also an intermediate portion 29 which extends parallel to the first end portion 21 but which has been shifted with respect thereto in the direction of the second end portion 23. The intermediate portion 29 adjoins the lower side of the base 5 so that it is not necessary to provide a groove 25 in the base. It may be desirable, however, to provide a filler block 30 underneath the base 5 adjacent the intermediate portion 29. Thus, the coil will not be supported only by the intermediate portion after mounting on a board comprising surface wiring; otherwise it might become inclined. If desired, the filler block 30 may be formed by a separate block of plastics which is glued against the lower side of the base 5. In that case a specially adapted mould will not be required for the formation of the base 5 (for example, by injection moulding).

Figure 4:
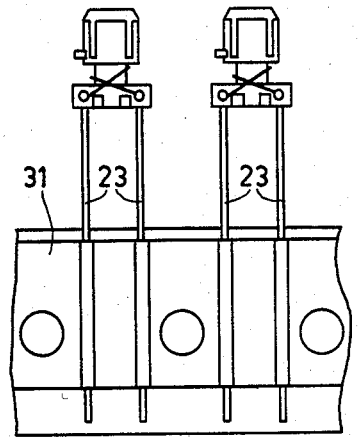
FIG. 4 is a side elevation of a part of a tape-like carrier with a number of coils in accordance with the invention for the automated mounting thereof.

FIG. 4 shows a part of tape-like carrier 31 in which coils in accordance with the invention are accommodated. A carrier of this kind may be wound onto a reel which can be arranged in a known machine for automated mounting. This machine gradually unwinds the carrier 31 from the reel and successively removes the coils one by one for mounting on a board comprising surface wiring, for example, by soldering. The second end portions 23 of the connection pins 19 of the coils are inserted into openings extending transversely of the longitudinal direction of the carrier 31. Therefore, the second end portions 23 are comparatively long; their length has an order of magnitude of a multiple of the length of the second end 13 of the connection contacts 9, for example, ten times the length thereof. After the removal of the coils from the carrier, the second end portions 23 can be cut off to a length which is desirable for mounting.

What is claimed is:

1. A high-frequency coil comprising a coil winding (1) which is provided on a coil form (3) whose axis (4) extends perpendicularly to a base (5) which comprises wire-shaped connection contacts (9) which extend perpendicularly to the axis and which are embedded in the material of the base so that both their ends (11, 13) project from the base, at least one lead (15) of the coil winding being connected to the first end (11), while the second end (13) serves to establish electrical contact with the coil, said coil comprising connection pins (19), each of which comprises a first end portion (21) which extends parallel to the second end (13) of one of the connection contacts (9) and which is electrically connected thereto, and also comprises a second end portion (23) which extends perpendicularly to the first end portion and parallel to the axis (4) of the coil form (3).

2. A high-frequency coil as claimed in claim 1, wherein the connection between the connection contact (9) and the connection pin (19) is formed by a welded joint (27).

3. A high-frequency coil as claimed in claim 1 or 2, wherein the axis (4) of the coil former (3) and the second end portions (23) of at least two of the connection pins (19) are situated in a common plane.

4. A high-frequency coil as claimed in claim 1 wherein the connection pins (19) are formed so as to be L-shaped, the first end portion (21) of each connection pin extending in a groove (25) which is recessed in the base (5) and which also accommodates the portion of the connection contact (9) which adjoins the second end (13) thereof.

5. A high-frequency coil as claimed in claim 1 wherein the length of the second end portion (23) of the connection pin (19) has an order of magnitude of a multiple of the length of the second end (13) of the connection contact (9).

* * * * *